United States Patent [19]

Wiker et al.

[11] Patent Number: 4,829,899

[45] Date of Patent: May 16, 1989

[54] TIMING CONTROL SYSTEM

[75] Inventors: Gordon A. Wiker, Arcadia; George H. Wells, Jr., La Verne, both of Calif.

[73] Assignee: The United States of America as represented by the Adminstrator National Aeronautics and Space Administration, Washington, D.C.

[21] Appl. No.: 154,711

[22] Filed: Feb. 11, 1988

[51] Int. Cl.[4] ..... F42C 11/06

[52] U.S. Cl. ..... 102/206; 102/215

[58] Field of Search ..... 102/200, 206, 215; 89/6, 6.5

[56] References Cited

U.S. PATENT DOCUMENTS

| | | | |
|---|---|---|---|
| 3,500,746 | 3/1970 | Ambrosini | 102/70.2 |
| 3,657,571 | 4/1972 | Martin et al. | 102/215 |
| 3,739,726 | 6/1973 | Pintell | 102/70.2 |
| 3,851,589 | 12/1974 | Meyer | 102/70.2 |
| 3,888,181 | 6/1975 | Kups | 102/206 |
| 3,958,510 | 5/1976 | Stutzle | 102/70.2 |
| 3,964,395 | 6/1976 | Kaiser et al. | 102/70.2 |
| 4,022,102 | 5/1977 | Ettel | 89/6.5 |
| 4,137,850 | 2/1979 | Donner | 102/215 |
| 4,142,442 | 3/1979 | Tuten | 89/6.5 |
| 4,147,109 | 4/1979 | Ziemba | 102/215 |
| 4,445,434 | 5/1984 | Brede et al. | 102/206 |
| 4,454,815 | 6/1984 | Beck | 102/206 |
| 4,577,561 | 3/1986 | Perry | 102/215 |
| 4,644,864 | 2/1987 | Komorowski et al. | 102/215 |
| 4,649,796 | 3/1987 | Schmidt | 89/6.5 |

*Primary Examiner*—Charles T. Jordan

*Attorney, Agent, or Firm*—Thomas H. Jones; John R. Manning; Paul F. McCaul

[57] ABSTRACT

A timing control system is disclosed which is particularly useful in connection with simulated mortar shells. Special circuitry is provided to assure that the shell does not overshoot, but rather detonates early in case of an improper condition; this ensures that ground personnel will not be harmed by a delayed detonation. The system responds to an externally applied frequency control code which is configured to avoid any confusion between different control modes. A premature detonation routine is entered in case an improper time-setting signal is entered, or if the shell is launched before completion of the time-setting sequence. Special provisions are also made for very early launch situations and improper detonator connections. An alternate abort mode is provided to discharge the internal power supply without a detonation in a manner that can be externally monitored, thereby providing a mechanism for non-destructive testing. The abort mode also accelerates the timing function for rapid testing.

36 Claims, 8 Drawing Sheets

| | Time in mS, Freq in Hz | | | | Time delay to Fire (Secs) | Time to dis-charge (mSec) | COMMENTS | |
|---|---|---|---|---|---|---|---|---|
| | Reset freq. time | Set freq. time | Set Freq. | Abort Freq. time | | | | |
| 1 | 500 | 260 | 32768+ | 0 | 24 | | | Longest set-time allowed |
| 2 | " | " | " | 10 | | 375 | Aborted | " |
| 3 | " | " | 32768- | 0 | 4 | | | Set-time too long |
| 4 | " | " | " | 10 | | 62.5 | Aborted | " |
| 5 | " | " | 65536 | 0 | 16 | | | Median set-time |
| 6 | " | " | " | 10 | | 250 | Aborted | " |
| 7 | " | " | 98304- | 0 | 8 | | | Shortest set-time allowed |
| 8 | " | " | " | 10 | | 125 | Aborted | " |
| 9 | " | " | 98304+ | 0 | 4 | | | Set-time too short |
| 10 | " | " | " | 10 | | 62.5 | Aborted | " |
| 11 | " | 125+ | 98000 | 0 | 4 | | | Early launch |
| 12 | " | 0 | 0 | 125+ | | 62.5 | Aborted | " |
| 13 | " | 125- | 98000 | 0 | | 32000 | | Very early launch |
| 14 | " | 0 | 0 | 125- | | 500 | Aborted | " |
| 15 | 200 | 0 | 0 | 130 | | 62.5 | | Final projo production test |

FIG.5.

TIMING CONTROL SYSTEM

ORIGIN OF INVENTION

The invention described herein was made in the performance of work under a NASA contract, and is subject to the provisions of Public Law 96-517 (35 USC 202) in which the Contractor has elected not to retain title.

BACKGROUND OF THE INVENTION

1. Field of the Invention

This invention relates to timing circuits, and more particularly to timing systems for training devices used to simulate mortar fire.

2. Description of the Related Art

Simulated mortar fire is employed in war games and other training exercises to provide a more realistic combat situation. The devices are fired from a launcher which operates by compressed air and calculates the desired trajectory and delay period until detonation, so that simulated explosions occur in the air over the trainees. The detonation produces a visual flash, an audible blast and smoke.

Detonation timers for other types of projectiles have typically been concerned with avoiding premature detonations to be sure the devices do not explode while still in the launcher. With simulated mortar fire, the problem has been found to be exactly the opposite. Whereas the launchers employed can typically withstand the force of a simulated mortar explosion, any unforeseen delay in the detonation can result in the projectile over-shooting its intended location and either exploding dangerously close to ground personnel, or actually striking someone.

No simulated mortar devices are available which have adequate safeguards against delayed detonation, or are selfchecking. Detonation timing systems designed for other applications, such as that disclosed in U.S. Pat. No. 4,644,864 to Komorowski et al., do not satisfy the needs of simulated mortar fire. Komorowski et al. is designed primarily for detonating a chaff-dispensing projectile for use in radar decoy operations. It employs a variable timing mechanism within the projectile that is inductively coupled with a control means in the launcher. A train of tone-burst modulated pulses are transmitted over the inductive coupling to the projectile, where the pulses are used to charge up a power storage capacitor. The pulses also set a counter in the projectile to the desired time delay between launching the projectile and its detonation to dispense the radar decoy chaff. The counter commences a counting-out operation at a predetermined rate in response to the projectile being launched, at the end of which operation the capacitor is discharged to initiate the detonation.

In addition to the requirements of having an accurate time setting device and avoiding the overshoot which results from too long a delay period before detonation, it would be very desirable to have a non-destructive technique for testing the operation of the timing system. At present, testing is accomplished by actually detonating a sampling of a production run, and projecting the results onto the entire run. This of course does not take individual variances into account, and is also wasteful.

In addition to accurate timing and a non-destructive test capability, the cost and size of simulated mortar projectiles should be as small as possible, with accompanying low power requirements.

SUMMARY OF THE INVENTION

In view of the above problems, an object of the present invention is the provision of a novel and improved time delay system which can easily be programmed to any one of a variety of different delay times, and which includes safeguards against overshoot and improper settings.

Another object is the provision of such a system with a novel coding arrangement that permits the rapid input of program information with a high degree of accuracy and security.

Still another object is the provision of such a system with an alternate abort mode that locks out a detonation and can be used for rapid non-destructive testing of the device.

It is also an object of the invention to provide a timing system that is uniquely suited to simulated mortar fire, and which is low cost and has low power requirements.

These and other objects are accomplished with a timing control system which is responsive to the control frequency of an input signal within a predetermined time-setting frequency range to set a desired delay time for actuating a device. The timing circuitry is initially reset by the application of a reset signal within a frequency range that is segregated from the time-setting input frequency; by making the reset frequency range higher than the time-setting range, reset input signals cannot be mistaken for time-setting signals during the initial period when the circuit's clock oscillator is powering up. The termination of an initial reset signal triggers a delayed sampling of the input signal to determine the subsequent time-setting frequency. The timer begins to timeout toward an actuation when the input signal is terminated. However, actuation is inhibited if the input signal terminates less than a predetermined delay period after the end of a reset signal.

The timing system also has an abort mode that diverts the output of a power supply away from an actuation, and instead discharges the power supply through an input/output inductive winding so that the discharge can be externally sensed. The abort mode is preferably entered in response to an input control signal within a frequency range that is different from the reset and time-setting frequency ranges, and preferably requires the abort signal to last for at least a predetermined period of time corresponding to a plural number of successive samples. The abort mode is particularly useful for non-destructive testing. It causes the system's power supply capacitor to discharge back through the input communications coil, thereby permitting the operation of the system to be monitored externally. It accelerates the operation of the timer control circuit, permitting testing to be completed considerably faster than in actual field use.

When used to control the detonation of a projectile, the system tests for and responds to various discrepancies by causing a detonation after a delay period which is less than the lowest settable time delay. This causes the projectile to detonate early when it is generally harmless, rather than to overshoot and risk injury to personnel on the ground from impact or delayed detonation. The conditions that lead to this early detonation are a delay set-time which exceeds or is less than the permissible set-time limits, and an early launch indicated by an insufficient interval for the time set input following a reset. For a sensed very early launch condition, the power supply capacitor is discharged after a relatively long delay period. The system is not given a premature detonation as in the other discrepancy conditions because the very early launch indicator may represent a faulty clock oscillator which cannot be relied upon to set any detonation period.

The system thus allows for a quick and efficient input of program information from an external source, can be quickly and non-destructively tested, and enters an appropriate alternate detonation mode when an improper condition is detected. These and other features and objects of the invention will be apparent to those skilled in the art from the following detailed description of a preferred embodiment, taken together with the accompanying drawings, in which:

DESCRIPTION OF THE DRAWINGS

FIG. 5 is a table of various operating conditions and non-destructive test options and the results thereof;

DETAILED DESCRIPTION OF A PREFERRED EMBODIMENT

The present detonator timing system employs a unique frequency-based code for setting the time for an actuation to occur, for initially resetting the system, and for entering an abort mode for non-destructive testing of the system. Although it may have numerous applications, the preferred embodiment will be described with reference to a detonation control system for a projectile such as a simulated mortar shell.

Figure 1:
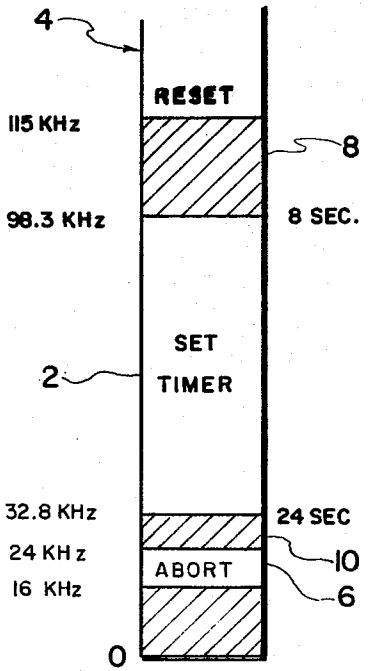
FIG. 1 is a bar chart indicating the various input control frequency ranges for a preferred embodiment of the invention.

A preferred code frequency spectrum is illustrated in FIG. 1; although nominal specific frequencies are given, these are generally arbitrary and not limiting. A mid-band frequency range 2 from 32.8 KHz to 98.3 KHz is reserved for setting a timer that controls the delay period until detonation. The programmed delay period is inverse to the input frequency, with 32.8 KHz corresponding to a delay period of 24 seconds and 98.3 KHz to a delay period of 8 seconds. As explained further below, the time delay is programmed into the timing system by application of a valid frequency for at least 0.26 seconds after the system has been reset. Launching the projectile initiates the timeout to detonation.

The frequency range of 115 KHz and above is reserved as a reset range 4. An input control frequency within this range resets all of the internal counters and flip-flops within the timing system. Although somewhat lower frequencies might also be detected as a reset signal on some occasions depending upon the relative phasing between the input frequency and the crystal oscillator employed in the timing system, and their relative jitter, the frequency deadband between the nominal set-time and reset ranges assures that the highest valid set-time frequency (98.3 KHz) will not be detected as a reset signal.

During power-up the system's crystal oscillator may start momentarily at a frequency lower than its resonant frequency of 32.768 KHz. Since the reset function is detected by a comparison of the input frequency with the internal oscillator frequency, the actual control frequency that will cause reset will therefore be lower while the crystal is achieving stability. However, any frequency above 115 KHz will always be interpreted as reset no matter how slow the oscillator is operating.

The nominal frequency range of 16 KHz–24 KHz is reserved for an abort function 6. An abort input is delivered for testing purposes, and causes a storage capacitor in the timing system to harmlessly discharge rather than detonate the device. The capacitor discharge can be externally sensed, thereby permitting the operation of the system to be externally monitored. Since the same type of jitter considerations apply as for reset, the actual range of frequencies that will be detected as abort will be broader by some unspecified amount. The launcher should preferably apply 20 KHz (±10%) for 5 milliseconds to guarantee safety during power failure, but the actual range of abort frequencies is greater than ±20%. The abort condition is latched, and the only frequency that can unlatch it is reset. If abort comes up set on power-up, it will be overridden by the reset frequency as the oscillator starts. The lowest frequency that can set a valid time delay (24 seconds) is 32.768 KHz, which is well above the abort range. As explained further below, the operation of the timing system is accelerated during abort, preferably by a factor of 64, so that testing can be done without having to wait for the full delay periods used in the field.

Detected input frequencies in the deadband 8 between the set-time and reset ranges, and the deadband 10 between the set-time and abort ranges, respectively, are treated as invalid inputs. The timing system responds to these frequencies by entering a shorter detonation delay sequence that causes the projectile to detonate in 4 seconds. This is considerably less than the minimum set-time period of 8 seconds, and assures that the projectile will detonate before it has an opportunity to overshoot and cause damage.

Figure 2:
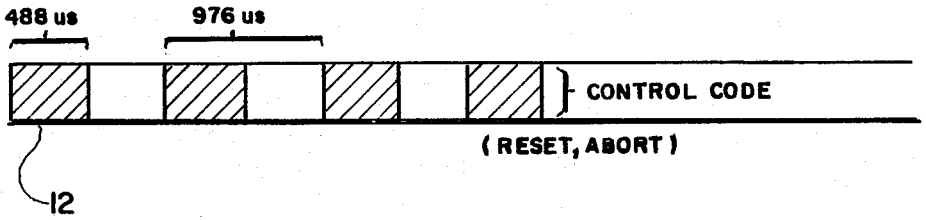
FIG. 2 is a bar graph representing a reset/abort input control code pattern.

The timing system employs two separate sampling periods. The first of these is used to detect the control codes RESET and ABORT, and is illustrated in FIG. 2. Code sample windows 12 are 488 microseconds wide, and are repeated at a nominal 1 KHz (actually 1.024 KHz) rate to produce sample cycles 976 microseconds wide. The ABORT input requires a frequency between 16 KHz and 24 KHZ during four consecutive code sample windows. ABORT can be applied either before, during or after the set-time frequency input.

Figure 3:
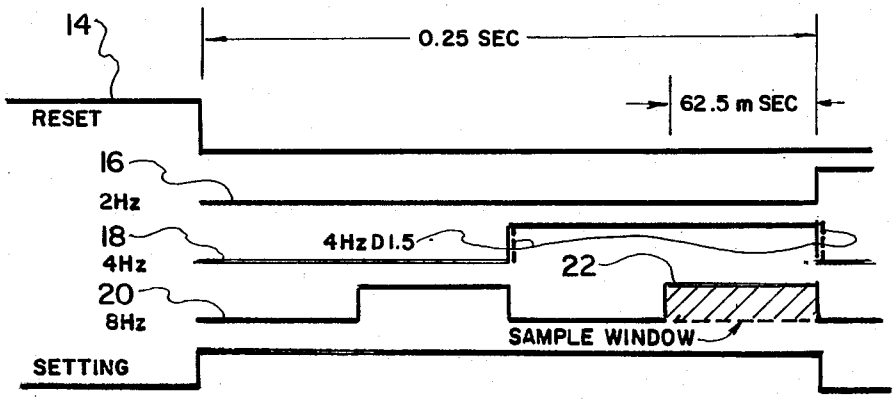
FIG. 3 is a series of signal traces illustrating the set-time signal sampling which occurs after a reset signal.

The second sampling period is used for setting the time delay. This period begins immediately after the end of the reset period, and is illustrated in FIG. 3. A 10 millisecond margin is added to the 0.25 second set-time frequency duration to establish a 0.26 second total period. Immediately after the end of the RESET signal 14, the timing circuitry produces 2 Hz, 4 Hz and 8 Hz pulses 16, 18 and 20, respectively. The input set-time frequency is sampled during the 62.5 millisecond window 22 at the end of the set-time period when the 4 Hz and 8 Hz pulses coincide. The set-time frequency is gated into the timer during sample window 22 to preload the set-time. The SETTING and 4 HzD1.5 signals shown in FIG. 3 are discussed below.

A valid launch can occur any time after the end of the set-time sampling period. Launch is detected as any input frequency lower than the 16 KHz–24 KHz ABORT range, and is updated at a 1.024 KHz sampling rate. As soon as the launch condition is detected, the normal timeout sequence is started unless an abnormal condition has been detected. The maximum time after the frequency pulses end until the timeout actually starts is 1.5 milliseconds. The entire operation of the timing system must be started over again if either the ABORT or RESET condition is detected.

Figure 4:
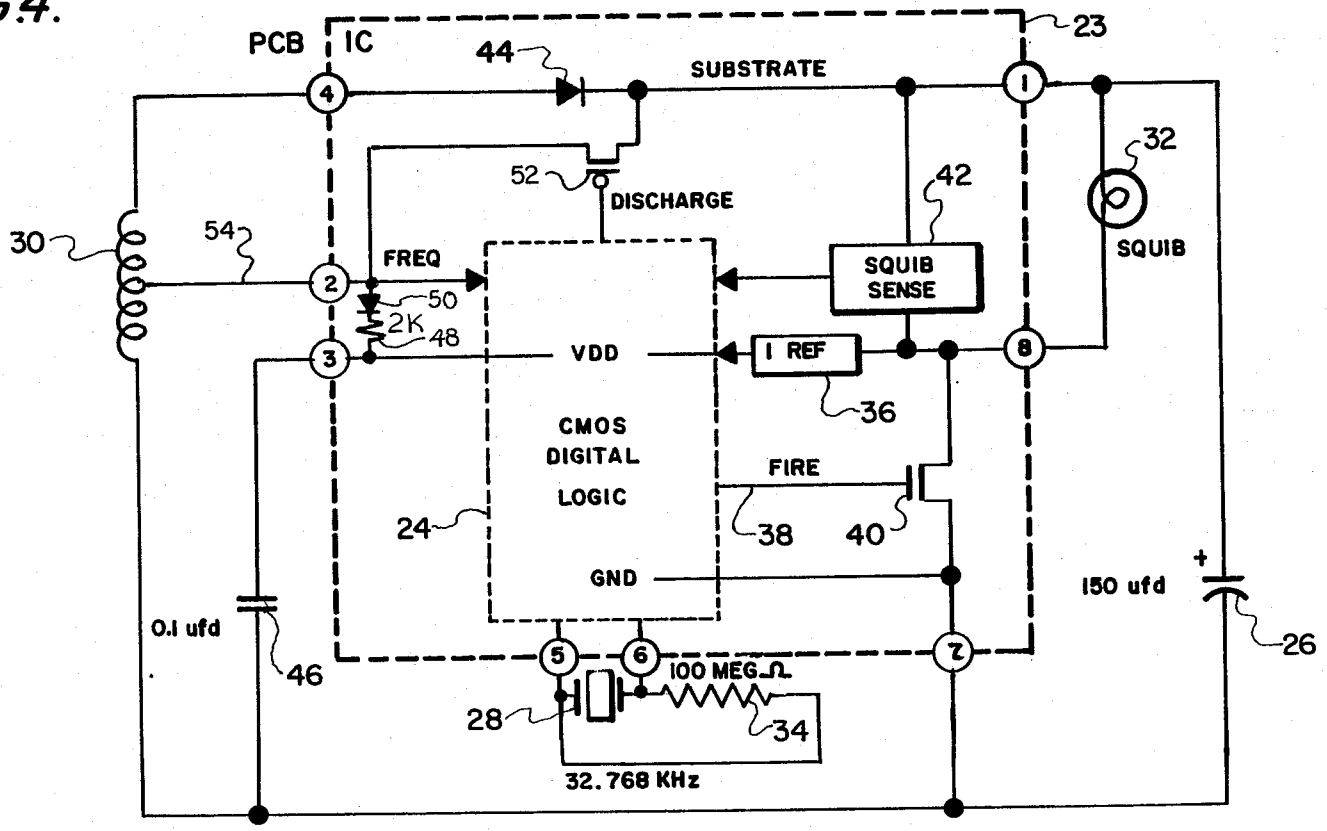
FIG. 4 is a block diagram of the discrete system elements which are interconnected with an integrated circuit control chip in the preferred embodiment.

A block diagram of the timing system is provided in FIG. 4. The circuitry consists of a custom CMOS integrated circuit 23, a 150 microfarad storage capacitor 26, a 0.1 microfarad filter capacitor 46, a 32.768 KHz quartz crystal 28, a six-turn printed circuit pickup coil 30 (preferably 1.625 in. in diameter), and a squib 32 which when actuated actually produces the detonation. In addition to the digital logic on the IC chip, most of the discrete components are also integrated onto the chip to reduce costs and increase reliability. The only component that to date has not been successfully integrated is a 100 Megohm crystal oscillator bias resistor 34 due to its extremely high impedance.

The power supply capacitor 26 is connected through the squib 32 to provide power for a 5 microamp current regulator 36, which in turn powers the CMOS timing circuit 24. The current regulator circuit 36 has a special low power design discussed later. The squib is fired when a signal is delivered from the timing circuit over line 38 to a fire field effect transistor (FET) 40, which closes a circuit between the squib and the power supply capacitor. FET 40 is a 1 ohm N-channel device.

A squib sensing circuit 42 detects whether the squib is making proper contact on the circuit board by sensing the voltage across the squib. This voltage is normally almost zero because of the squib's very low resistance. If any appreciable voltage is detected, indicating that the squib is not properly connected, the timing logic circuitry 24 immediately produces a signal which causes the power capacitor 26 to be discharged. This prevents an unintended detonation should the squib be reconnected when the projectile impacts the ground.

The power supply capacitor 26 is initially charged by a charging signal inductively applied from the launcher to the input coil 30, which in turn transmits the charging signal through a diode 44 to the capacitor. The charging energy preferably comes from a fly-back transformer technique in the launcher that starts with a wide (about 2.5 microseconds) negative pulse of low amplitude (−1 volt on the secondary) and ends with a narrow (400 nanosecond) positive pulse of much higher amplitude (+8 volts on the secondary). The repetition rate is between 20 and 115 KHz. The desired energy is in the positive pulses, but the negative pulses are required due to the fly-back technique which generates pulses of high enough voltage (150 volts on the primary) to couple across the inefficient path from the launcher (primary) coil to the projectile (secondary) coil 30. A 0.1 microfarad filter capacitor 46 is connected in series with a 2K resistor 48 and a diode 50 between a center tap of coil 30 and the opposite side of power supply capacitor 26. The resistor 48 limits the filter capacitor's rate of rise to avoid latch-up problems.

Discharge of the power capacitor 26 in the event of an abort command or an improper squib placement is controlled by a 100 ohm P-channel FET 52. The operation of discharge transistor 52 is controlled by the digital logic 24. The transistor is connected between the power capacitor 26 and the coil center tap 54. When it is gated, the discharge transistor allows the power capacitor to discharge directly through the coil. This produces a coil signal that can be detected from the launcher (or test set-up) to verify that a discharge has occurred. Coil 30 thus serves as both an input mechanism for transmitting signals to the timing system, and as an output mechanism for indicating that a discharge has occurred. The frequency control signals for reset, abort and set-time are all applied from center tap 54 to the logic circuitry 24.

FIG. 5 is a table illustrating the programming and operation of the timing system for various detonation and abort sequences. Fifteen different sets of inputs are shown. In all but the last set of inputs, each is initiated with the application of a proper reset frequency for 500 milliseconds. The input on line 1 illustrates the normal operation of the system for the longest permissible set-time of 24 seconds. A set-time frequency of slightly greater than 32.768 KHz is applied for 260 milliseconds. Since this is within the permissible set-time frequency range, it results in a detonation after the desired delay period of 24 seconds. Input number 2 represents the same conditions, but with the addition of an abort control input for 10 milliseconds. This causes the system to enter the abort mode and accelerate by a factor of 64. Accordingly, the power capacitor discharges into the input/output coil after 375 milliseconds (24 seconds divided by 64), rather than firing the squib.

In line 3 a set-time frequency less than 32.768 KHz is applied. Since this is below the permissible set-time frequency range, the timing system enters its alternate timeout mode for improper settings and causes a detonation in 4 seconds. The non-destructive test for this operation is illustrated in line 4, in which an abort input is applied to produce a power capacitor discharge in 62.5 milliseconds (4 seconds divided by 64).

In line 5 a proper mid-range set-time frequency of 65.536 KHz is applied, resulting in a detonation delay period of 16 seconds. Test verification is provided on lie 6 with an abort input that produces a capacitor discharge in 250 milliseconds. A minimum 8 second detonation delay resulting from a set-time frequency slightly less than 98.304 KHz is shown on line 7, with its test verification on line 8.

On line 9 a set-time frequency slightly greater than the 98.304 KHz maximum is applied, resulting in a detonation in 4 seconds. Test verification through the abort sequence is shown on line 10.

It is also desired that the projectile be detonated quickly if is it launched before the set-time input has been completed, thereby eliminating any chance of an overshoot. This early launch condition is illustrated on line 11, in which the set-time frequency has been applied for somewhat more than 125 milliseconds but less than the full 260 millisecond period. As in the case of an improper set-time frequency, detonation is produced in 4 seconds.

An abort test in which no set-time frequency is applied, but rather an abort frequency is continued into the set-time period, is shown on line 12. The result is a discharge in 62.5 milliseconds, the same as for any other aborted improper set-time frequency.

Line 13 illustrates the "very early launch" mode which is defined as a launch that occurs within the first 125 milliseconds after the end of a reset signal. This represents a special case, since if it occurs in an actual launcher in the field it is most likely due to a crystal that takes too long to start oscillating at the correct frequency, and therefore accurate timing is not possible. In this event it is not considered desirable to ever attempt to fire the squib, since there is no way to predict or control the timing. Therefore, the circuitry will guarantee a dud by causing an abort-type discharge of the power capacitor 32 seconds after launch. If the storage capacitor cannot maintain its charge for this length of time, the discharge will not occur. The conditions on line 13 can thus be used to determine whether the capacitor can hold its charge for 32 seconds.

The abort conditions on line 14 are similar to those of line 12, with no set-time frequency applied but with the abort frequency extending into the set-time period. On line 14, however, the abort frequency ends in less than 125 milliseconds, rather than extending beyond 125 milliseconds as on line 12. This simulates a "very early launch", and produces a discharge after 0.5 seconds (32 seconds divided by 64).

Line 15 represents a final package test that must be performed in an explosion-safe environment and is designed to test the mechanically sensitive parts of the system (the crystal, squib and capacitor contacts). The test involves applying the reset frequency for about 200 milliseconds, followed by an abort frequency for 130 milliseconds, and then measuring the time to discharge which can be one of three values. If everything is working correctly, the discharge will occur 62.5 milliseconds after launch, since the sequence is an aborted early-launch, improper set-time condition. If the crystal oscillator is defective in some way and results in the frequency taking too long to stabilize, then the sequence will look like an aborted "very early launch", and will cause discharge 500 milliseconds after launch. If the squib is not making contact, then the squib sensing circuit will cause discharge within 30 milliseconds of launch. If the capacitor or other circuitry has failed in some gross way, no discharge will be detected and the part should be rejected. There are other failure modes that can result in an explosion occurring either on application of the charging pulses or any time thereafter if a discharge condition is not detected; therefore, the testing facility must provide some way of destroying or containing such failed parts.

A wide variety of non-destructive tests are thus possible with the novel timing system. The abort mode makes it possible to test for various types of improper inputs, and can also be used to determine the actual operating frequency ranges of the device being tested. For example, by testing with a range of frequencies slightly above and below the limits of the nominal permissible set-time frequency range, the actual set-time range for the device being tested can be accurately determined.

Figure 6:
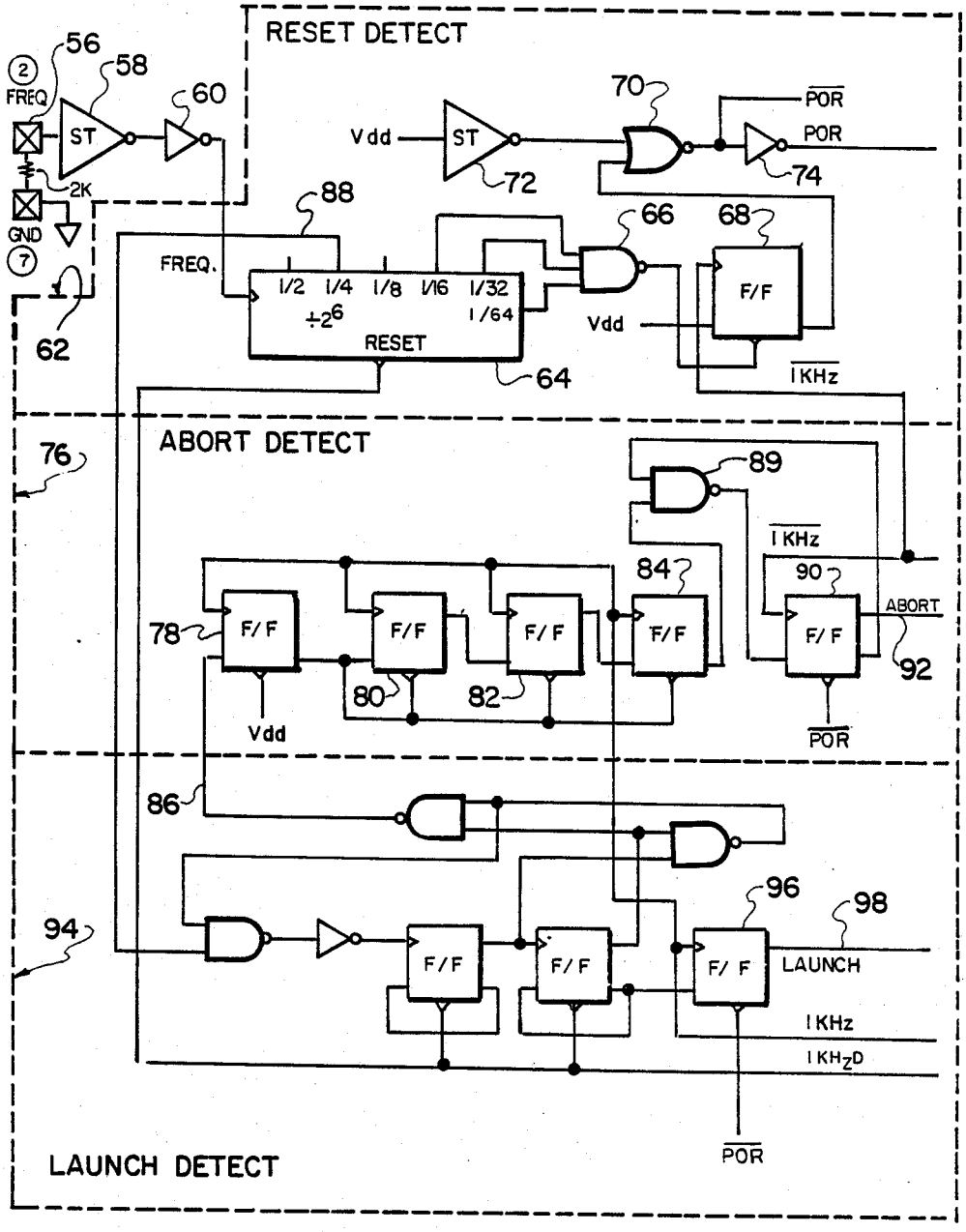
FIGS. 6, 7 and 8 are schematic diagrams of the reset, abort and launch detection circuitry, of the timer and timer control circuitry, and of the detonation and discharge circuitry, respectively.

Details of the system circuitry will now be described. FIG. 6 shows the chip circuitry used to detect reset, abort and launch inputs. The control signal from the input coil is applied to a frequency input terminal 56, and from there through a schmitt trigger circuit 58 and inverter 60 to the reset detect circuit enclosed in dashed lines 62. The frequency input signal is applied to a six stage counter 64, from which outputs are taken representing the total number of input pulses divided by 16, 32 and 64, respectively. These three outputs are supplied to a NAND gate 66, which in turn operates a flip-flop 68 supplied with a nominal 1 KHz (1.024 KHz) signal. A similar nominal 1 KHz (actually 1.024 KHz) signal periodically resets counter 64 to establish the 976 microsecond sample cycles referred to in connection with FIG. 2.

The output of flip-flop 68 is applied to a NOR gate 70, which receives an unused input from the voltage supply $V_{DD}$ through schmitt trigger circuit 72. The output of NOR circuit 70 indicates the negation of either a reset signal or a power on condition; this signal is inverted by inverter 74 to indicate the presence of a reset signal. Any time the number of counts by counter 64 during a code sample window reaches 56, a reset signal is produced at the output of inverter 74. The lowest input frequency corresponding to this count is $56 \times 2.048 = 115$ KHz, which provides some tolerance for the nominal 115 KHz reset frequency. The POR output of inverter 74 in FIG. 6 refers to "power on reset".

The circuitry for detecting an abort signal is enclosed within dashed line 76. It consists of a series of four flip-flops 78, 80, 82 and 84 interconnected as shown. The first flip-flop 78 receives over line 86 the input signal divided by 4, which signal is transmitted over line 88 from counter 64 and processed through the launch detect circuit discussed below. The flip-flops 78, 80, 82 and 84 are actuated in succession each time an input signal is received within the 16 KHz–24 KHz abort code range. The abort signal must be present for four successive samples to actuate all four flip-flops. This requirement is made so that a launch will not be detected as an abort in case the launch occurs between samples, and to account for the transition at the beginning of the launch when the projectile is leaving the breech coil. A NAND gate 89 and flip-flop 90 are interconnected at the output of flip-flop 84, with the 1 KHz enable clock signal and the lack of reset- signal applied to flip-flop 90. When an abort input code is present for four successive sample windows, flip-flop 90 produces a corresponding output over output line 92. This abort signal sets the timeout control circuitry, discussed below, into the abort mode.

The launch detection circuitry enclosed in dashed line 94 detects any input frequency lower than the abort range as an indication that the projectile has been launched. 16 KHz thus acts as an upper threshold for launch detection. The circuitry shown is supplied with the nominal 1 KHz clock signal so that the launch detection is updated on each sample at a 1.024 KHz rate. The maximum time after the input frequency pulses end until the timeout actually starts is 1.5 milliseconds. An output flip-flop 96 assures that reset is not present, and produces the launch indication over output line 98.

Figure 7:
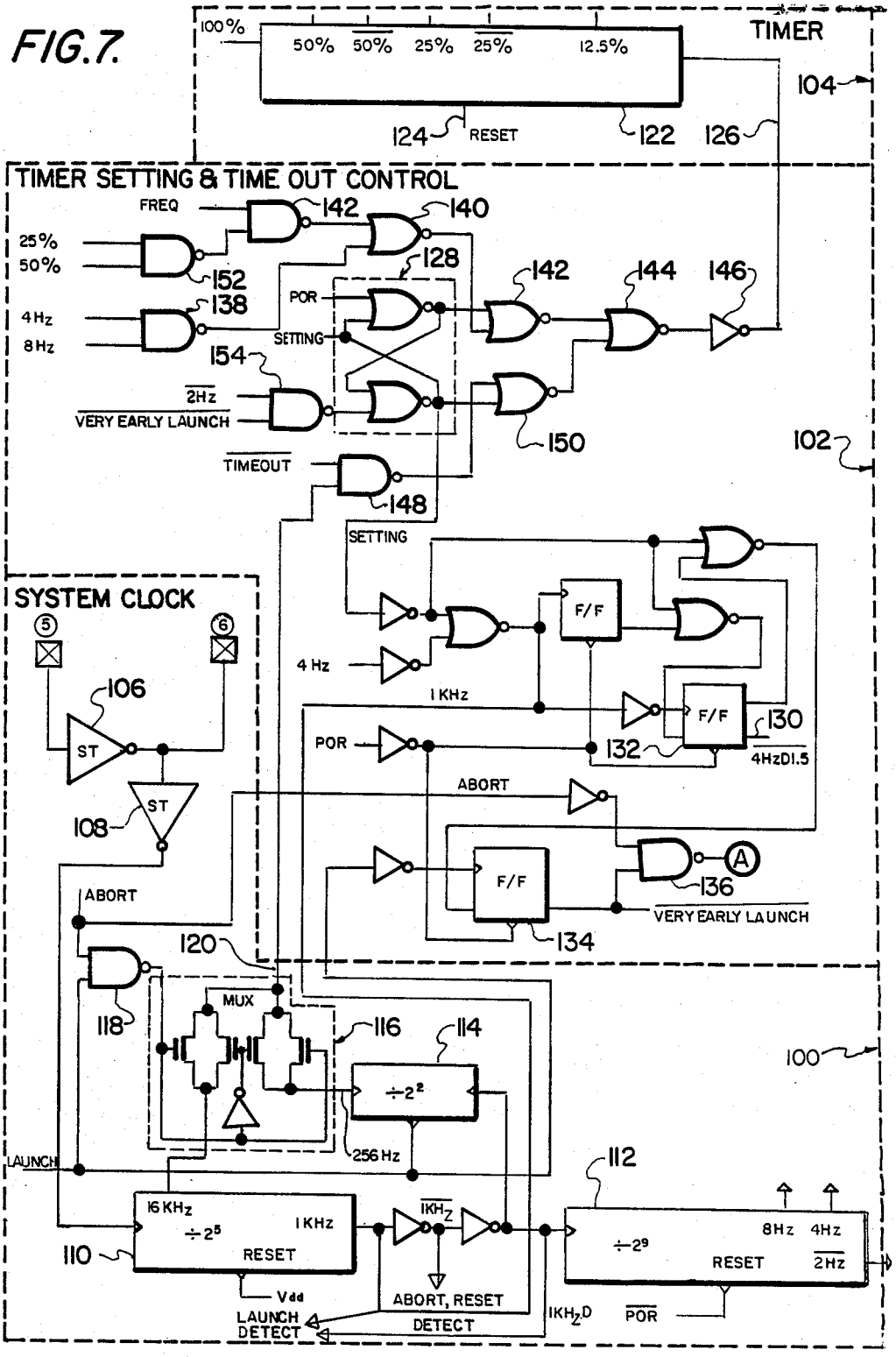

Referring now to FIG. 7, a schematic diagram of the system clock 100, timer setting and timeout control circuitry 102 and timer 104 is provided. The system clock 100 is set from the crystal oscillator 28 shown in FIG. 4. The active circuit for the crystal oscillator is a CMOS schmitt trigger 106 with the external 100 Megohm bias resistor 34. At very low $V_{DD}$ supply voltages, in the order of 1 volt, schmitt trigger 106 does not have enough bandwidth to allow the crystal to define the frequency, and it oscillates at a very low frequency. The output of the oscillator has significant slope on its transitions, requiring a second schmitt trigger 108 to allow low power operation and eliminate the possibility of extra counts being picked up by the downstream flip-flops.

All of the timing references are provided by the oscillator frequency divided by a five-stage counter 110, which produces the 1.024 KHz reference frequency at the output of its final stage. The only time a higher frequency is used is after launch for an aborted condition, when all the normal timer functions operate at 64 times their normal speed (16 KHz instead of 256 Hz). The reset, abort and launch counters described above operate continuously and are updated at the 1.024 KHz rate.

Immediately after the reset input has terminated a nine-stage counter 112, which is supplied with the nominal 1 KHz reference frequency, provides 8, 4 and 2 Hz output signals. These signals are used for the set-time frequency sample window 22 described in connection with FIG. 3.

A 256 Hz signal is developed by a two-stage counter 114 in response to the nominal 1 KHz reference and is supplied to a multiplexer circuit 116, which is also supplied with a 16 KHz signal from counter 110. The simultaneous presence of abort and launch conditions is brought into the multiplexer via NAND gate 118, and causes a 16 KHz output over multiplexer output line 120 when both signals are present. Otherwise, a 256 Hz signal is produced over multiplexer output line 120 when enabled by a launch signal applied to the counter 114 reset.

The timer section 104 consists of a fourteen-stage counter 122 which is controlled by reset input 124 to operate in the absence of an input reset signal. Outputs are taken from the counter at 12.5% of its capacity (to produce a premature detonation in case of an improper time-setting), at the 25% and 50% of capacity levels, and at the 100% level to indicate the conclusion of a timeout. The counter 122 counts up and responds to a time-setting signal on line 126 from the timer setting and timeout control circuit 102. In normal operation, this signal is the time-setting frequency that is applied to the projectile, and causes the counter 122 to count up by a corresponding amount during the 62.5 milliseconds frequency sampling window. After the window is completed, the counter retains its count until a launch is detected. At that point pulses are applied to line 126 at either the 256 Hz rate for a normal timeout, or at the 16 KHz rate for an accelerated abort timeout.

With a time-setting frequency at the lower end of the permissible range, in the vicinity of 32 KHz, counter 122 will initially count up only to about 25% of its capacity, while with a higher time-setting frequency in the order of 98 KHz the counter will initially count up to about 75% of capacity. Thus, the higher the time-setting frequency, the lower will be the unused capacity remaining in the counter. As the counter continues to count up after launch, a low initial time-setting frequency will therefore result in a longer timeout because of the greater unused capacity, while the inverse will be true for a high initial time-setting frequency.

The sequence of timer operation is controlled by the circuitry in the lower right portion of the timer setting and timeout control circuit 102. The operation of this circuitry is more easily understood if FIG. 3 is also referred to. Immediately after clock counter 112 produces a positive 2 Hz signal for the first time, the output of a NOR-gate flip-flop 128 in the timer setting circuitry goes low; this output is referred to as SETTING. It sets the detonation timer 122 at whatever count has been reached at the end of the frequency sampling window 22. An additional timing signal produced by the circuitry is the 4 Hz clock signal inverted and delayed by 1.5 milliseconds, which is referred to in the figure as 4 HzD1.5; this signal is produced on output 130 of flip-flop 132. There is a 1.5 millisecond overlap between SETTING first going low and the 4 HzD1.5 signal; during this time the improper conditions are sampled. The improper conditions are the timer being less than 25% or more than 75% full, or launch having already occurred. Any one of these improper conditions will reset the timer 122 to zero and cause timeout to occur at 12.5% of the 32 second maximum timeout (4 seconds). The circuitry which implements this accelerated timeout is described later.

If launch occurs before the first occurrence of 4 Hz going high, a flip-flop 134 is set which immediately ends SETTING and causes timeout to go to 100% (32 seconds). The presence of either this condition or abort is sensed by a NAND gate 136, which produces a signal at output A causing the discharge FET 52 rather than the fire FET 40 to be turned on at the conclusion of timeout. As mentioned previously, the abort condition also causes timeout to occur 64 times faster.

The frequency of the time-setting signal applied to counter 122 is controlled by the circuitry in the upper left portion of the timer setting and timeout control circuit 102. The coincidence of a 4 Hz and an 8 Hz clock pulse, which corresponds to the 62.5 millisecond sample window 22, is sensed by NAND gate 138, the output of which gates a NOR gate 140 to pass the time-setting frequency signal received by NAND gate 142. In the absence of any improper conditions, the time-setting signal is then passed through NOR gate 142, NOR gate 144 and inverter 146 to the timer input 126. Here it causes the timer to count up to the desired timeout setting.

During the timeout sequence following launch, the 256 Hz normal or 16 KHz abort control signal is passed by NAND gate 148 and NOR gate 150 to NOR gate 144. The other input to NOR gate 144 is held low because the coincident 4 Hz and 8 Hz pulses have terminated. This enables the timeout control signal to be passed through NOR gate 144 and inverter 146 to control the rate of timeout by timer 122. The 256 Hz output of counter 114 is not present until launch occurs and releases the counter reset.

Figure 8:
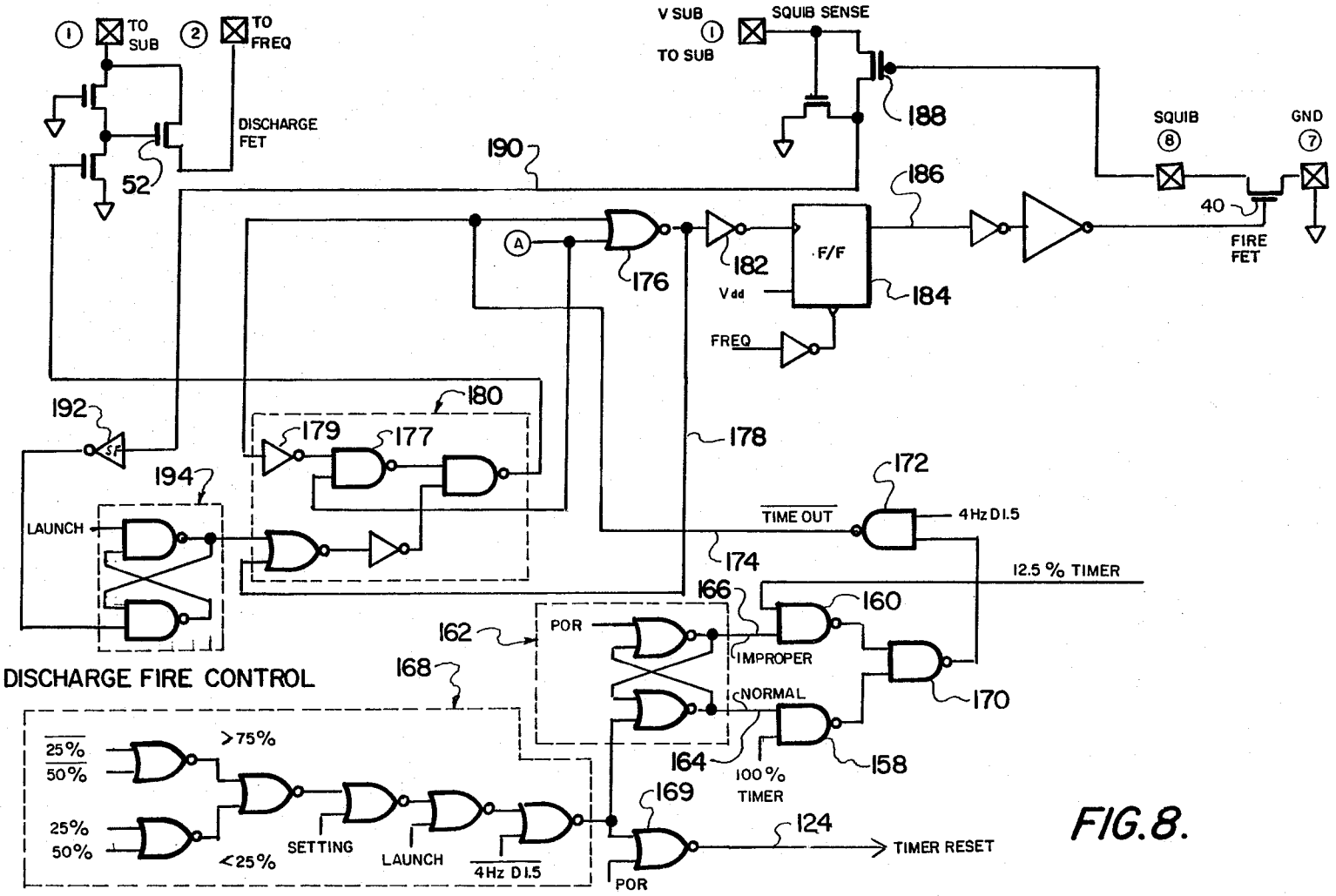

The 100% output of timer 122 is applied to a NAND gate 158, as shown in FIG. 8, while the 12.5% timer output is applied to one input of NAND gate 160. A flip-flop circuit 162 has two outputs, one of which 164 is applied to NAND gate 158 and indicates a normal condition, and the other of which 166 is applied to NAND gate 160 and indicates an improper condition. The improper conditions to which flip-flop 162 responds are established by a series of NOR gates 168, and include the timer 122 being either less than 25% or more than 75% full, or a launch occurring during the SETTING prior to the end of the 4 HzD1.5 signal (the early launch condition). Either of these conditions will cause NOR gate 169, whose output is connected to the reset line 124 for timer 122, to reset the counter. Starting from zero, the counter will thus actuate its 12.5% output 4 seconds after launch if an improper time-setting or early launch has been detected.

The outputs of NAND gates 158 and 160 are applied to another NAND gate 170, the output of which in turn is connected to a further NAND gate 172. Gate 172 also responds to the absence of the 4 HzD1.5 signal to produce an inverted timeout signal over output line 174. This output is applied to NOR gate 176 and to NAND gate 177, which together act as a steering mechanism between the fire FET 40 and the discharge FET 52. NOR gate 176 and NAND gate 177 receive as their other inputs the abort signal A from NAND gate 136 in the timer setting and timeout control circuitry. When timeout has been completed, the inverted timeout input to NOR gate 176 will go low. This will produce a signal over line 178 at the output of NOR gate 176 that, when processed through logic circuit block 180, fires the discharge FET 52 and causes the power supply capacitor to discharge without a detonation.

The output of steering NOR gate 176 is inverted by inverter 182 which, in the absence of an abort command, produces a signal which is fed into flip-flop 184. This device then produces an output over line 186 to actuate the fire FET 40. This discharges the supply capacitor into the squib, causing it to detonate.

The squib condition is sensed by a transistor 188 which monitors the voltage across the squib. When that voltage exceeds a threshold level indicating that the squib is not properly connected, a signal is delivered over line 190 and through schmitt trigger 192 to a flip-flop circuit 194. This circuit responds to a combination of an improper squib connection and a launch condition to gate the discharge transistor 52 through logic circuit 180, causing the supply capacitor to immediately discharge. This prevents the squib from later detonating should it be reconnected upon impact.

Figure 9:
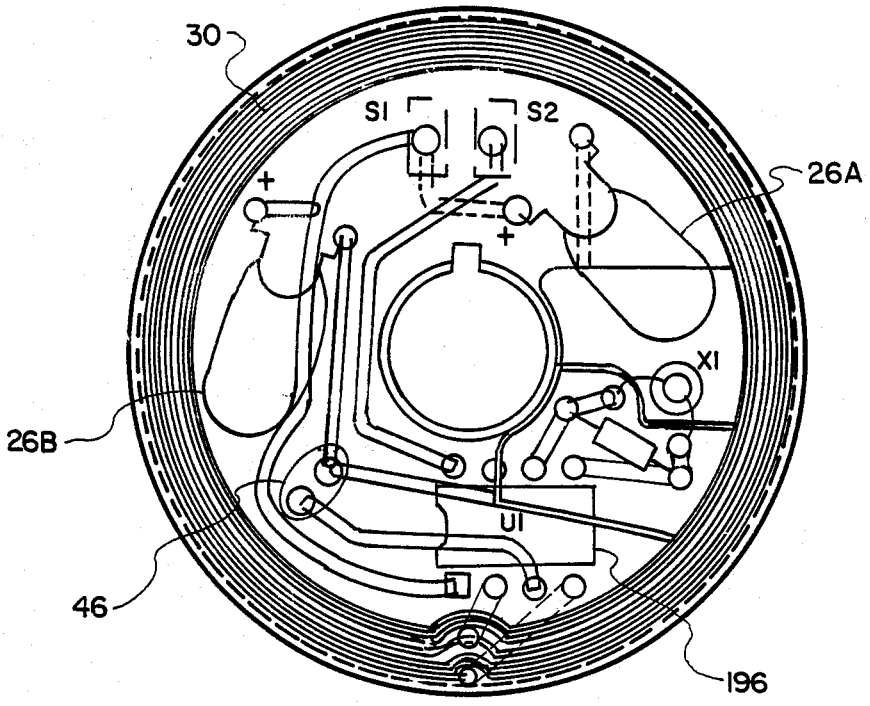
FIG. 9 is a plan view showing a layout of the various system elements within a projectile.

FIG. 9 shows the physical layout of the circuit board inside the projectile which supports the timing control system. Coil 30 is printed around the periphery of the circular board. The board is sized to fit within its projectile; for a typical simulated mortar shell, the board diameter is 1⅝ inch. Power supply capacitor 26 is implemented as two separate parallel capacitors 26A and 26B to satisfy the limited space availability. The integrated circuit chip which incorporates the control circuitry of FIGS. 6–8 is indicated by reference numeral 196.

Figure 10:
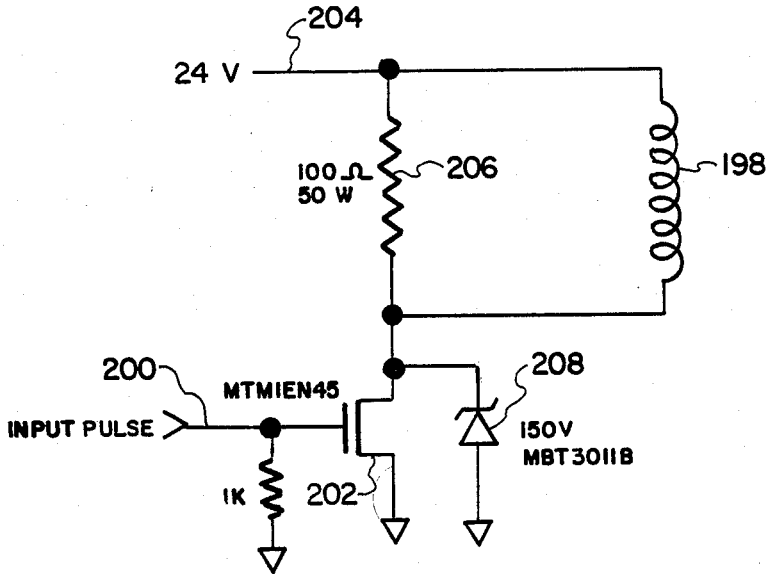
FIG. 10 is a schematic diagram of interface communications circuitry used with the preferred embodiment.

FIG. 10 shows the preferred diver circuitry in the launcher or test set-up which is used to initially charge the power supply capacitor 26, and thereafter to deliver control and time-setting signals to the projectile timing system. It includes a ten-turn coil 198 approximately 2.25 inches in diameter which surrounds the projectile and its printed circuit board. Input pulses are applied along the line 200 to the gate of an FET 202, which controls the flow of current from a 24 volt positive voltage bus 204 through the parallel circuit consisting of coil 198 and resistor 206. A zener diode 208 is connected parallel to FET 202 to limit the voltage across that device and regulate the voltage to the timer circuit.

Figure 11:
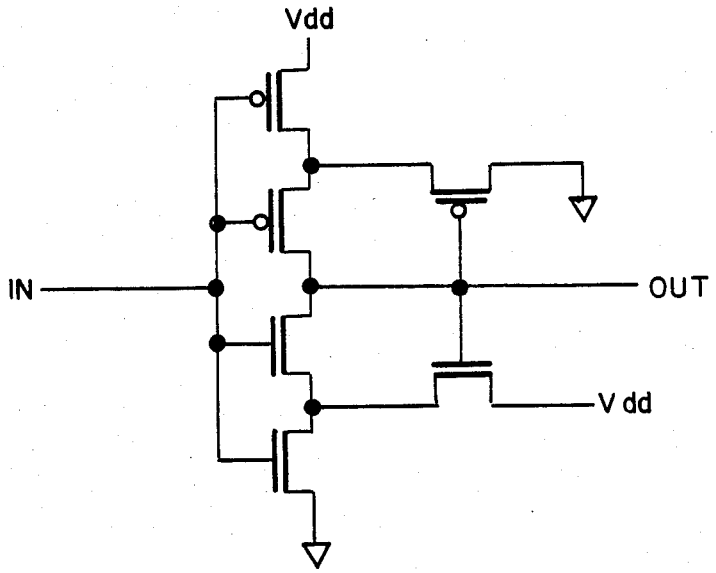
FIG. 11 is a schematic diagram of a preferred oscillator circuit.

A unique oscillator circuit is also employed which helps to achieve very low power operation. Standard schmitt trigger oscillators employ inverter buffer stages at the output of each schmitt trigger circuit. This requires additional resistors and capacitors, which in turn require more power and take longer to come up to speed. In the present invention, the schmitt trigger circuits 106 and 108 in the oscillator are single stage schmitt triggers, without output buffers. The simple circuitry employed by each schmitt trigger is shown in FIG. 11. This is a considerable improvement over prior oscillator circuits employing output buffer stages.

Figure 12:
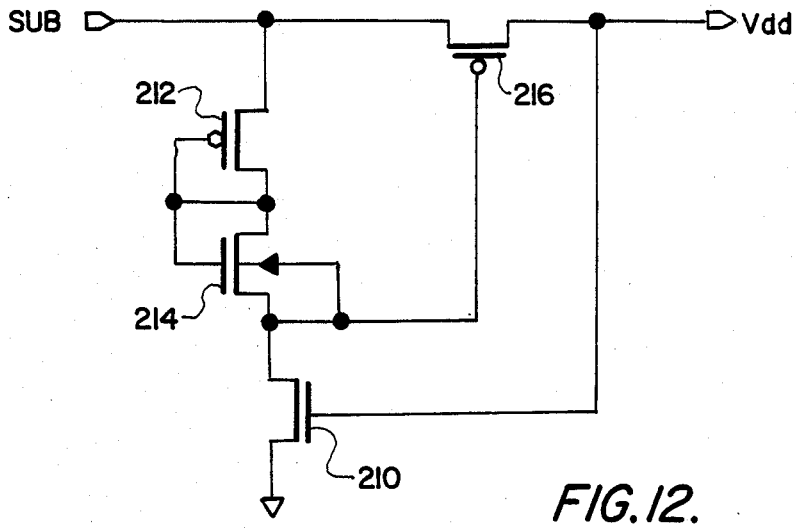
FIG. 12 is a schematic diagram of a preferred current regulator power source for the system circuitry.

The power requirements are also kept low by using a current source 36 rather than a voltage supply, such as a battery, to supply voltage to the CMOS circuitry. A unique regulator circuit is provided for the current source. Rather than simply using a resistor in series with a voltage source, which would waste considerable current at the beginning of the flight to be sure that sufficient voltage is left to fire the squib at the end of the flight, the transistor circuit of FIG. 12 is employed. A high impedance FET 210 functions as a current source, drawing current through series connected FETs 212 and 214 from the squib. The FET pair 212, 214 is connected across the gate-source terminals of another FET 216. The P-well of N-channel FET 214 is connected to its output. By connecting the output of FET 212 in common with the inputs to both FETs 212 and 214, a precisely controlled voltage is produced across the two transistors, independent of the voltage across the squib. The gate-source voltage of FET 216 is thereby held constant, producing a constant current for powering the CMOS circuitry.

A unique timing control system for detonating a projectile has thus been shown and described. While only one particular preferred embodiment has been discussed, it should be understood that numerous variations and alternate embodiments will occur to those skilled in the art. Accordingly, it is intended that the invention be limited only in terms of the appended claims.

We claim:

1. A timing control system having an actuator which is intended to be actuated a settable delay period after timing has started, comprising:

a timer, an actuation circuit responsive to the timer for enabling an actuation, input means for receiving an input signal having a control frequency, and a timer control circuit which is responsive to the control frequency of an input signal received by the input means within a predetermined time-setting frequency range, the timer control circuit setting the timer to enable an actuation after a delay period which varies according to the control frequency of the input signal within said time-setting frequency range.

2. The timing control system of claim 1, further comprising a reset circuit connected to reset the timer in response to an input signal having a control frequency within a predetermined reset frequency range.

3. The timing control system of claim 2, wherein said time-setting and reset control frequency ranges are mutually exclusive.

4. The timing control system of claim 3, wherein said timer control circuit includes a clock oscillator which provides a reference control frequency, and said reset control frequency range is at a higher frequency level than said time-setting frequency range, thereby preventing a reset signal from being interpreted as a time-setting signal when the oscillator is operating at less than the clock frequency during a power-up period.

5. The timing control system of claim 3, wherein said reset control frequency range comprises frequencies greater than approximately 115 KHz, and said time-setting frequency range is approximately 32 KHz–98 KHz.

6. The timing control system of claim 2, wherein said timer control circuit includes means for sampling the input control frequency a predetermined sample delay period after the end of a reset signal to determine the time-setting frequency.

7. The timing control system of claim 6, wherein said sampling means samples the input control frequency for a predetermined sample period which is less than said predetermined sample delay period.

8. The timing control system of claim 2, said timer control circuit including means for initiating a timeout of the timer in response to the frequency of the input signal at the input means falling below a threshold level.

9. The timing control system of claim 8, wherein said timer control circuit includes a clock oscillator which provides a reference control frequency, and further comprising means for inhibiting an actuation in response to the input signal frequency falling below said threshold level at a time less than a predetermined delay period after the end of a reset signal.

10. The timing control system of claim 9, wherein said predetermined time-setting frequency range corresponds to a predetermined actuation delay period range, and said timer control circuit includes means for sampling the input frequency for a predetermined sample period after the end of a reset signal, said timer control circuit further including means for initiating an actuation, after an actuation delay period which is less than said predetermined actuation delay period range, in response to the input signal frequency falling below said threshold level between the end of said predetermined delay period and the end of said predetermined sample period.

11. The timing control system of claim 8, wherein said predetermined time-setting frequency range corresponds to a predetermined actuation delay range, and said timer control circuit includes means for sampling the input frequency for a predetermined sample period after the end of a reset signal, said timer control circuit further including means for initiating an actuation after a shortened delay period in response to the input signal control frequency falling below said threshold level within a predetermined period of time prior to the end of said sample period.

12. The timing control system of claim 1, said timer control circuit being responsive to an input signal outside of said time-setting frequency range to set the system to an alternate actuation mode.

13. The timing control system of claim 12, wherein said predetermined time-setting frequency range corresponds to a predetermined actuation delay range, and said alternate actuation mode actuates after a delay period less than said predetermined actuation delay range.

14. The timing control system of claim 1, said input means comprising an inductance coil.

15. The timing control system of claim 1, further comprising an abort circuit responsive to the control frequency of an input signal within a predetermined abort frequency range for inhibiting an actuation.

16. The timing control system of claim 15, further comprising a reset circuit connected to reset the timer in response to an input signal having a control frequency within a predetermined reset frequency range.

17. The timing control system of claim 16, wherein said time-setting, abort and reset frequencies are mutually exclusive.

18. The timing control system of claim 17, wherein said abort circuit is responsive only to at least a predetermined plural number of successive abort signal samples to inhibit an actuation.

19. The timing control system of claim 15, wherein said actuation circuit means includes a power storage means supplying power for a timed actuation, and said abort circuit operates to discharge said power storage means.

20. The timing control system of claim 19, said abort circuit diverting the timer output to enable a discharge of said power storage means rather than enabling an actuation under the control of the timer control circuit.

21. The timing control system of claim 20, wherein said abort circuit is connected to accelerate the operation of the timer control circuit.

22. The timing control circuit of claim 19, said actuation circuit including a squib for initiating an actuation, and further comprising means for sensing the proper placement of the squib, and for discharging said power storage means when an improper squib placement is sensed.

23. A non-destructively testable detonation timing control system for a projectile, comprising:

a detonator, a power storage means, a timer, a detonation circuit which is responsive to the timer for transmitting power from the power storage means to actuate the detonator, an abort circuit for diverting power from the power storage means away from the detonator to inhibit a detonation, bi-directional input/output means for receiving input signals and for transmitting signals indicating the occurrence of an abort discharge, said abort circuit being responsive to an input abort signal received by the input/output means, a timer control circuit responsive to a time-setting input signal received by the input/output means for setting the timer to enable actuation of the detonator by the detonation circuit after a detonation delay period determined by the time-setting input signal, and an output circuit responsive to the operation of the abort circuit for delivering a signal to the input/output means indicating the occurrence of an abort.

24. The system of claim 23, said abort circuit and timer control circuits being responsive to input signals having frequencies within predetermined abort and time-setting frequency ranges, respectively.

25. The system of claim 23, further comprising a reset circuit connected to reset the timer in response to an input signal having a frequency within a reset frequency range.

26. The system of claim 25, said abort circuit, timer control circuit and reset circuit being responsive to input signals having frequencies within predetermined abort, time-setting and reset frequency ranges, respectively, said frequency ranges being mutually exclusive.

27. The system of claim 26, said abort, time-setting and reset frequency ranges being respectively and approximately 16 KHz–24 KHz, 32 KHz–98 KHz, and 115 KHz and above.

28. The system of claim 25, wherein said abort circuit is responsive only to at least a predetermined plural number of successive abort signal samples to inhibit a detonation.

29. The system of claim 26, said timer control circuit being responsive to the frequency of an input signal within said time-setting frequency range for setting the timer to a detonation delay period which varies according to the frequency of said input signal, said abort circuit diverting the timer output to enable the diversion of power from said power storage means after an abort delay period which is less than the minimum detonation delay period.

30. The system of claim 29, said abort circuit including a steering circuit connected in circuit with the timer output, the steering circuit enabling an actuation of the detonator in the absence of an abort input signal, and enabling a discharge of the power storage means in the presence of an abort input signal.

31. The system of claim 30, wherein said abort circuit is connected to accelerate the operation of the timer control circuit.

32. The system of claim 23, said input/output means comprising an inductive coil.

33. The system of claim 32, said output circuit routing power from the power storage means to at least a portion of said inductive coil, causing said coil to transmit a signal indicating the occurrence of an abort discharge.

34. The system of claim 23, said detonation circuit including a squib for initiating a detonation, and further comprising means for sensing the proper placement of the squib, and for actuating the abort circuit when an improper squib placement is sensed.

35. A timing control system having an actuator which is intended to be actuated a settable delay period after timing has started, comprising:

a timer, an actuator circuit responsive to the timer for enabling an actuation, input means for receiving an input control signal within a predetermined permissible range, and a timer control circuit which is responsive to an input control signal received by the input means within said permissible range for setting the timer to enable an actuation within a predetermined delay range, the time to actuation varying according to the level of the input signal within its permissible range, the timer control circuit being responsive to an input control signal received by the input means outside of said permissible range for setting the timer to enable an actuation after a delay which is less than said predetermined delay range.

36. The timing control system of claim 35, for detonating a simulated mortar shell, wherein said predetermined delay range is approximately 8–24 seconds after a launch of the shell, and said lesser delay is approximately 4 seconds after a launch.

* * * * *